US006443327B1

(12) United States Patent
Chen

(10) Patent No.: US 6,443,327 B1
(45) Date of Patent: Sep. 3, 2002

(54) COLLAPSIBLE SOFT ARTICLE DISPENSER

(76) Inventor: Michelle Chen, 1180 Karl St., San Jose, CA (US) 95122

( * ) Notice: Subject to any disclaimer, the term of this patent is extended or adjusted under 35 U.S.C. 154(b) by 43 days.

(21) Appl. No.: 09/679,412

(22) Filed: Oct. 4, 2000

(51) Int. Cl.[7] ..... A47F 1/04
(52) U.S. Cl. ..... 221/303; 206/315.9
(58) Field of Search ..... 221/33, 45, 303, 221/307, 309, 283; 206/315.9, 315.1; 224/919, 250, 251; 312/45, 49

(56) References Cited

U.S. PATENT DOCUMENTS 5,285,927 A * 2/1994 Pruitt ..... 221/303
D393,364 S * 4/1998 John ..... D3/221
5,772,090 A * 6/1998 Rodriguez ..... 221/307

* cited by examiner

*Primary Examiner*—Kenneth W. Noland
(74) *Attorney, Agent, or Firm*—Jack Lo

(57) ABSTRACT

The present soft article dispenser is comprised of a tube with an open loading end and a constricted dispensing end. The tube is comprised of a rolled up sheet of flexible and collapsible material, such as fabric, with opposite edges which are sewn together. A loading end reinforcing band and a dispensing end reinforcing band are provided at the corresponding ends of the tube. Each reinforcing band is comprised of a rolled up sheet of stronger material, such as leather or vinyl-coated fabric, with opposite edges which are sewn together. The constricted dispensing end is comprised of a disc sewn to the end of the dispensing end reinforcing band. A hole is provided in the disc. A loop is attached to the tube at the open loading end for hanging. Soft articles, such as small items of clothing, plastic bags, disposable gloves, etc., are stuffed snugly into the dispenser from the loading end. The soft articles are removable one-at-a-time through the hole at the dispensing end. When empty, the dispenser is collapsible for compact storage.

3 Claims, 1 Drawing Sheet

COLLAPSIBLE SOFT ARTICLE DISPENSER

BACKGROUND OF THE INVENTION

1. Field of the Invention

This invention relates generally to dispensers and containers for soft articles.

2. Prior Art

Many people tend to store small articles of clothing, such as socks, panty hoses, panties, etc., mixed together in a drawer. Some people even scatter them across furniture. The disorganization makes finding the desired item very troublesome. Although there are a variety of rigid add-on bins and drawers available on the market for storing such articles, they are relatively expensive, and they waste closet space when they are empty. Also, drawers cannot be packed too tightly, otherwise they cannot open or close easily. Therefore, they do not store the articles at the highest density for maximum space efficiency.

OBJECTIVES OF THE INVENTION

Accordingly, the objectives of the present dispenser are:

to store and organize soft articles;

to store soft articles at high density for maximum space efficiency;

to be collapsible when empty to avoid wasting closet space;

to be durable; and to be very inexpensive to produce.

Further objectives of the present invention will become apparent from a consideration of the drawings and ensuing description.

BRIEF SUMMARY OF THE INVENTION

The present soft article dispenser is comprised of a tube with an open loading end and a constricted dispensing end. The tube is comprised of a rolled up sheet of flexible and collapsible material, such as fabric, with opposite edges which are sewn together. A loading end reinforcing band and a dispensing end reinforcing band are provided at the corresponding ends of the tube. Each reinforcing band is comprised of a rolled up sheet of stronger material, such as leather or vinyl-coated fabric, with opposite edges which are sewn together. The constricted dispensing end is comprised of a disc sewn to the end of the dispensing end reinforcing band. A hole is provided in the disc. A loop is attached to the tube at the open loading end for hanging. Soft articles, such as small items of clothing, plastic bags, disposable gloves, etc., are stuffed snugly into the dispenser from the loading end. The soft articles are removable one-at-a-time through the hole at the dispensing end. When empty, the dispenser is collapsible for compact storage.

Figure 1:
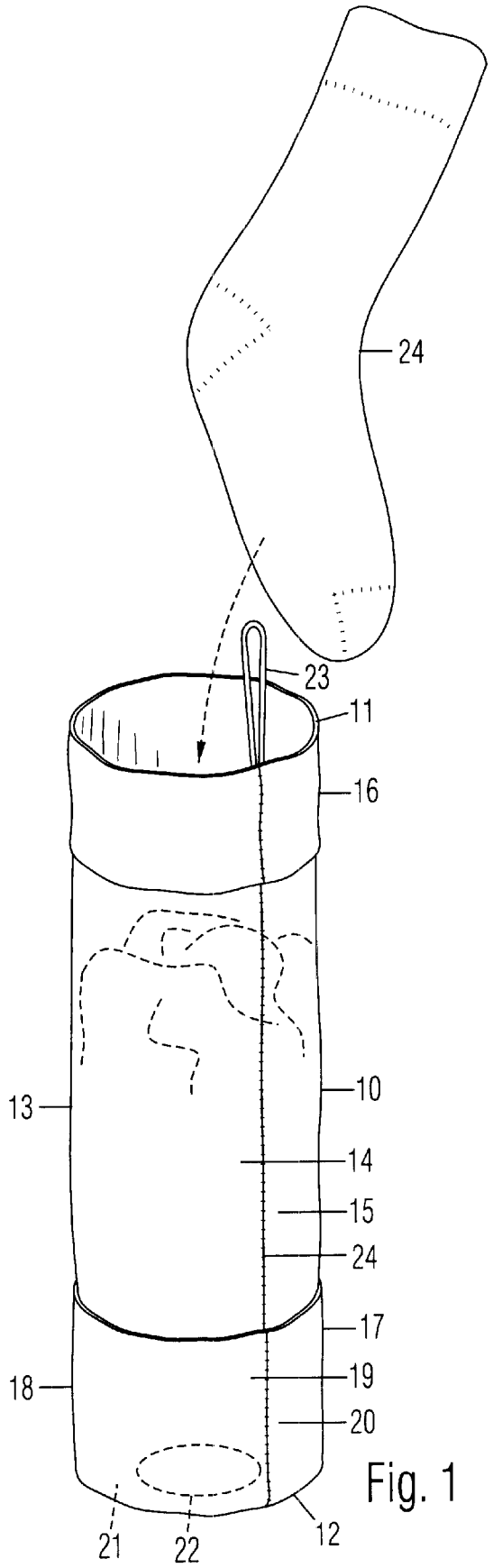
FIG. 1 is a side perspective view of the present soft article dispenser when a soft article is being loaded into it.

| DRAWING REFERENCE NUMERALS |
|---|
| 10. Tube |
| 11. Open Loading End |
| 12. Constricted Dispensing End |
| 13. Rolled-Up Flexible Sheet |
| 14. Edge |
| 15. Edge |
| 16. Reinforcing Band |
| 17. Reinforcing Band |
| 18. Rolled-Up Reinforcing Sheet |
| 19. Edge |
| 20. Edge |
| 21. Disc |
| 22. Hole |
| 23. Loop |
| 24. Seam |

DETAILED DESCRIPTION OF THE INVENTION

A preferred embodiment of the present soft article dispenser is shown in FIG. 1. It is comprised of a tube 10 with an open loading end 11 and a constricted dispensing end 12. Tube 10 is preferably comprised of a rolled-up flexible sheet 13 of a collapsible material, such as fabric, with opposite edges 14 and 15 which are sewn together along a seam 24. Tube 10 may also be made of another collapsible material, such as canvas, vinyl, etc. A loading end reinforcing band 16 and a dispensing end reinforcing band 17 are provided at the corresponding ends of tube 10. Each reinforcing band 16 or 17 is preferably comprised of a rolled-up reinforcing sheet 18 of a stronger material, such as leather or vinyl coated fabric, with opposite edges 19 and 20 which are sewn together. Constricted dispensing end 12 is preferably comprised of a disc 21 of a stronger material, such as leather or vinyl coated fabric, sewn to the end of dispensing end reinforcing band 17. A hole 22 is provided in disc 21. A loop 23 is attached to tube 10, preferably to loading end reinforcing band 16, for hanging on a closet or wall hook. Loop 23 is preferably attached to tube 10 adjacent seam 24. When the dispenser is hung up, seam 24 would be positioned against the wall or door and is thus hidden from view for a more attractive appearance.

Alternatively, reinforcing bands 16 and 17, and disc 21 may be made of another durable material, such as webbing. The dispenser may be made in any diameter and length. The simple construction of the dispenser makes it very inexpensive to produce.

Figure 2:
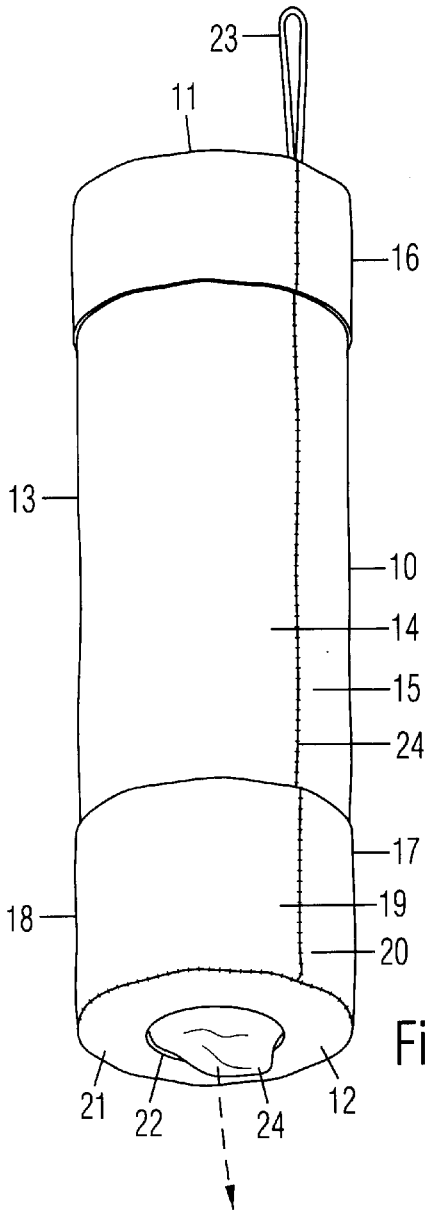
FIG. 2 is a side perspective view thereof dispensing the soft article.

Soft articles 24, such as small items of clothing, plastic bags, disposable gloves, etc., are stuffed snugly into the dispenser from loading end 11. A sock is shown as an example. Soft articles 24 are prevented from falling out dispensing end 12 by disc 21. The dispenser is thus useful for storing and organizing a variety of soft articles, and for storing them at high density for maximum space efficiency. As shown in FIG. 2, soft articles 24 are removable one-at-a-time through hole 22 at dispensing end 12. When empty, the dispenser is collapsible to avoid wasting closet space. The dispenser is durable because tube 10 is reinforced at loading end 11 where soft articles might be forcefully stuffed in at high density, and at dispensing end 12 where soft articles might be forcefully pulled out from the densely packed tube. Also, loop 23 is attached to loading end reinforcing band 16 for durability, since tube 10 would tend to be forcefully pulled downwardly during dispensing.

Although the above description is specific, it should not be considered as a limitation on the scope of the invention, but only as an example of the preferred embodiment. Many variations are possible within the teachings of the invention. For example, different attachment methods, fasteners, materials, dimensions, etc. can be used. The relative positions of the elements can vary, and the shapes of the elements can vary. Therefore, the scope of the invention should be determined by the appended claims and their legal equivalents, not by the examples given.

I claim:

1. A soft article dispenser, comprising:

a collapsible tube comprised of a rolled up flexible sheet with opposite edges joined along a longitudinal seam;

an open loading end on said tube for receiving soft articles;

a constricted dispensing end on said tube partially closed with a disc for dispensing said soft articles;

a hole arranged in said disc for preventing said soft articles from falling out, yet enabling said soft articles to be pulled through; and a loop attached to said tube adjacent said open loading end for hanging, wherein said loop is attached to said tube adjacent said seam, so that when said dispenser is hung up, said seam is hidden from view.

2. A soft article dispenser, comprising:

a tube with an open loading end for receiving soft articles, and a constricted dispensing end for dispensing said soft articles, wherein said tube is comprised of:

a rolled-up flexible sheet of a collapsible material;

a loading end reinforcing band encircling said loading end, wherein said loading end reinforcing band is comprised of a first sheet of reinforcing material stronger than said collapsible material for durability when said soft articles are forcefully stuffed through said loading end; and a dispensing end reinforcing band encircling said dispensing end, wherein said dispensing end reinforcing band is comprised of a second sheet of reinforcing material stronger than said collapsible material for durability when said soft articles are forcefully pulled through said dispensing end;

wherein said constricted dispensing end is comprised of a disc of a third sheet of reinforcing material stronger than said collapsible material sewn to a rim of said dispensing end reinforcing band; and a hole arranged in said disc for enabling said soft articles to be pulled through.

3. A soft article dispenser, comprising:

a tube with an open loading end for receiving soft articles, and a constricted dispensing end for dispensing said soft articles, wherein said tube is comprised of:

a rolled-up flexible sheet of a collapsible material with opposite edges joined along a longitudinal seam;

a loading end reinforcing band encircling said loading end, wherein said loading end reinforcing band is comprised of a first sheet of reinforcing material stronger than said collapsible material for durability when said soft articles are forcefully stuffed through said loading end; and a dispensing end reinforcing band encircling said dispensing end, wherein said dispensing end reinforcing band is comprised of a second sheet of reinforcing material stronger than said collapsible material for durability when said soft articles are forcefully pulled through said dispensing end;

wherein said constricted dispensing end is comprised of a disc of a third sheet of reinforcing material stronger than said collapsible material sewn to a rim of said dispensing end reinforcing band;

a hole arranged in said disc for enabling said soft articles to be pulled through; and a loop attached to said loading end of said tube for hanging, wherein said loop is attached to said loading end reinforcing band for durability since said tube would tend to be pulled forcefully downwardly during dispensing;

wherein said loop is attached to said tube adjacent said seam, so that when said dispenser is hung up, said seam is hidden from view.

* * * * *